United States Patent [19]

Ludszeweit et al.

[11] Patent Number: 4,721,119

[45] Date of Patent: Jan. 26, 1988

[54] ROD MAKING MACHINE WITH MEANS FOR ADJUSTING THE POSITION OF WRAPPING MATERIAL

[75] Inventors: Dieter Ludszeweit, Hamburg; Jürgen Gömann, Dassendorf, both of Fed. Rep. of Germany

[73] Assignee: Körber AG, Hamburg, Fed. Rep. of Germany

[21] Appl. No.: 938,262

[22] Filed: Dec. 5, 1986

[30] Foreign Application Priority Data

Dec. 18, 1985 [DE] Fed. Rep. of Germany ..... 3544769

[51] Int. Cl.[4] ..... A24C 5/18; A24C 5/24; B31C 13/00

[52] U.S. Cl. ..... 131/69; 131/67; 131/90; 131/84.1; 493/39; 493/42; 493/49

[58] Field of Search ..... 131/84.4, 84.3, 84.1, 131/84.2, 906, 67, 68, 69, 90; 493/39, 42, 49

[56] References Cited

U.S. PATENT DOCUMENTS

| | | | |
|---|---|---|---|
| 4,010,911 | 3/1977 | Heitmann | 156/505 |
| 4,185,644 | 1/1980 | Heitmann et al. | 131/109.1 |
| 4,538,626 | 9/1985 | Hinzmann | 131/84.4 |
| 4,610,260 | 9/1986 | Heitmann | 131/84.3 |

*Primary Examiner*—V. Millin

*Attorney, Agent, or Firm*—Peter K. Kontler

[57] ABSTRACT

A cigarette rod making machine wherein a garniture tape transports a web of cigarette paper and a stream of tobacco particles through a wrapping mechanism has a device which monitors the position of the tape in the wrapping mechanism and adjusts a pulley for the tape when the position of the tape relative to the adhesive applicator is unsatisfactory. The applicator delivers a film of adhesive against one marginal portion of the web on the tape before the web is converted into a tube which confines the particles of tobacco. The adjustments of the pulley are carried out with a view to move the tape sideways so as to maintain a predetermined part of the one marginal portion of the web in a position to receive the adhesive.

9 Claims, 3 Drawing Figures

MONITORING DEVICE
COMPARATOR
REFERENCE SIGNALS
REVERSIBLE MOTOR
SENSORS
MONITORING DEVICE

ROD MAKING MACHINE WITH MEANS FOR ADJUSTING THE POSITION OF WRAPPING MATERIAL

BACKGROUND OF THE INVENTION

The invention relates to machines for the production of rod-shaped commodities wherein a stream of filler of fibrous material is confined in a tubular wrapper. Typical examples of such machines are those which are used to make cigarette rods, filter rods and similar rods which can be subdivided into rod-shaped articles (such as cigarettes, cigars, cigarillos or filter rod sections) of the tobacco processing industry. The following description will deal primarily or exclusively with the making of cigarettes; however, it is to be understood that the invention can be embodied with equal or similar advantage in other types of rod making machines, especially those which are used to turn out rod-shaped smokers' products.

A cigarette rod making machine (such as a machine known as PROTOS which is produced by the assignee of the present application) comprises a wrapping mechanism wherein a continuous trimmed or equalized stream of tobacco particles is draped into a continuous web of cigarette paper or other suitable wrapping material. The web is directed toward the wrapping station by a first guide, and a second guide is provided to control the position of the so-called garniture tape (or garniture band) which is an endless belt conveyor serving to advance the web and the stream through the wrapping mechanism past a device which partially drapes the web around the stream and compacts the stream to convert it into a rod-like filler, an adhesive applicator which coats one marginal portion of the web with a suitable adhesive, a device which completes the draping of the web around the filler so that the two marginal portions of the web form the customary seam extending in parallelism with the axis of the resulting cigarette rod, and a so-called sealer which is used to influence the setting of the adhesive to thus ensure that the tubular wrapper of the cigarette rod will stand the stresses which develop during transport of the rod through a cutoff wherein the rod is subdivided into plan cigarettes of unit length or multiple unit length.

Proper positioning of both components of the cigarette rod during travel toward and through the wrapping mechanism, as well as accurate positioning of parts which cooperate in advancing the web and the stream toward the wrapping station and in treating the web and the stream in the wrapping mechanism proper is of utmost importance because defective cigarettes must be segregated from satisfactory cigarettes and even slight deviations of the characteristics of cigarettes from a prescribed norm can result in segregation of large numbers of rejects because a modern cigarette maker turns out up to and in excess of 8000 cigarettes per minute. One of the important parameters is the manner in which a film of adhesive is applied to one marginal portion of the web in the wrapping mechanism. For example, if the film of adhesive is applied too close to the free edge of the respective marginal portion of the web, a portion of the film is squeezed out of the space between the overlapping seams when the conversion of the web into a tube is completed whereby the exposed part of the adhesive film contaminates the cigarette rod and/or the adjacent parts of the wrapping mechanism and the adhesive on such parts can interfere with proper transport of next-following increments of the web and affect the diameter of the cigarette rod. Alternatively, the film of adhesive can be applied too far away from the free edge of the respective marginal portion of the web so as to affect the appearance and stability of the seam, i.e., the wrapper of the cigarette rod is likely to burst open ahead of or not later than in the cutoff.

OBJECTS AND SUMMARY OF THE INVENTION

An object of the invention is to provide a rod making machine wherein the web and the stream of fibrous material can be converted into a rod in such a way that the quality and appearance of the rod are maintained within an acceptable range and wherein all, even minor, deviations of the position, orientation and/or other parameters of the constituents of the rod as well as of the parts which influence such constituents can be eliminated automatically and without delay.

Another object of the invention is to provide the machine with novel and improved guide means for the garniture tape and for the web of wrapping material.

A further object of the invention is to provide a novel and improved wrapping mechanism for use in the above outlined machine.

An additional object of the invention is to provide the machine with novel and improved means for ensuring predictable and satisfactory application of adhesive to the running web of cigarette paper or other wrapping material.

Still another object of the invention is to provide the machine with novel and improved means for rapidly and predictably altering the position of the garniture tape and of the web of wrapping material thereon as soon as the position of the tape deviates, even so slightly, from an optimum position.

A further object of the invention is to provide a novel and improved method of controlling the position of garniture tape and web of wrapping material in a cigarette rod making or like machine for mass production of rod-shaped smokers' products.

Another object of the invention is to provide a novel and improved arrangement for altering the position of the garniture tape without necessitating any reductions of the output of the rod making machine.

The invention is embodied in a machine for converting a continuous stream of fibrous material (e.g., a stream containing or consisting of tobacco shreds) and a continuous web of wrapping material (such as cigarette paper) into a rod-like product, such as a cigarette rod. The machine comprises a wrapping mechanism or sizing part (e.g., a mechanism used by the assignee of the present application in the cigarette rod making machine known as PROTOS), means for directing the web from a reel or another suitable source toward the wrapping mechanism, an endless foraminous belt or other suitable means for transporting the stream to the wrapping mechanism, means for conveying the web and the stream through the wrapping mechanism including an endless conveyor 9 known as garniture tape or garniture band) which serves to receive the web from the directing means and the stream from the transporting means and to transport the web and the stream in the wrapping mechanism along a predetermined path, adjustable guide means for the conveyor, means for applying to the web a film of adhesive during transport through the wrapping mechanism, means for monitoring the position of the conveyor in the wrapping mechanism and for generating signals which denote the monitored position of the conveyor, and means for adjusting the guide means (when necessary) in response to the signals.

The adjusting means can comprise an adjustable motor (e.g., a reversible gear motor) which is operable to change the position of the guide means (and hence the position of the conveyor with reference to the wrapping mechanism and with reference to the adhesive applying means), and means for transmitting signals from the monitoring means to the motor. The signal transmitting means can comprise a comparator having a first input connected with the output of the monitoring means, a second input and an output connected with the motor. The second input of the comparator is connected to a preferably adjustable source of reference signals which denote the desired or optimum position of the conveyor.

The machine can further comprise means for supporting the monitoring means in a predetermined position with reference to the adhesive applying means to thus ensure that the position of the conveyor is ascertained in or close to the region where the web (which is transported by the conveyor) receives a film of adhesive.

The monitoring means can comprise a plurality of photoelectronic sensors (e.g., two reflection type photocells).

The guide means can comprise a pulley which has a circumferential groove bounded by a concave surface contacting the conveyor, and the adjusting means can comprise a feed screw (operated by the aforementioned reversible motor) to move the pulley axially.

The directing means can comprise second adjustable guide means (e.g., a second pulley having a circumferential groove bounded by a concave surface which contacts the web), means for monitoring the position of the web ahead of the wrapping mechanism and for generating second signals which denote the position of the web, and means for adjusting the second guide means in response to the second signals. The adjusting means for the second guide means can comprise an axially movable feed screw for the second pulley and a reversible motor which can move the second feed screw axially in a first or in a second direction, and the means for transmitting second signals from the second monitoring means to the adjusting means for the second guide means can again comprise a comparator and a source of reference signals.

The monitoring means for the conveyor can comprise means for monitoring a longitudinally extending marginal portion of the conveyor. The sensor or sensors of the just mentioned monitoring means can be placed adjacent the path of movement of the web with the conveyor.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
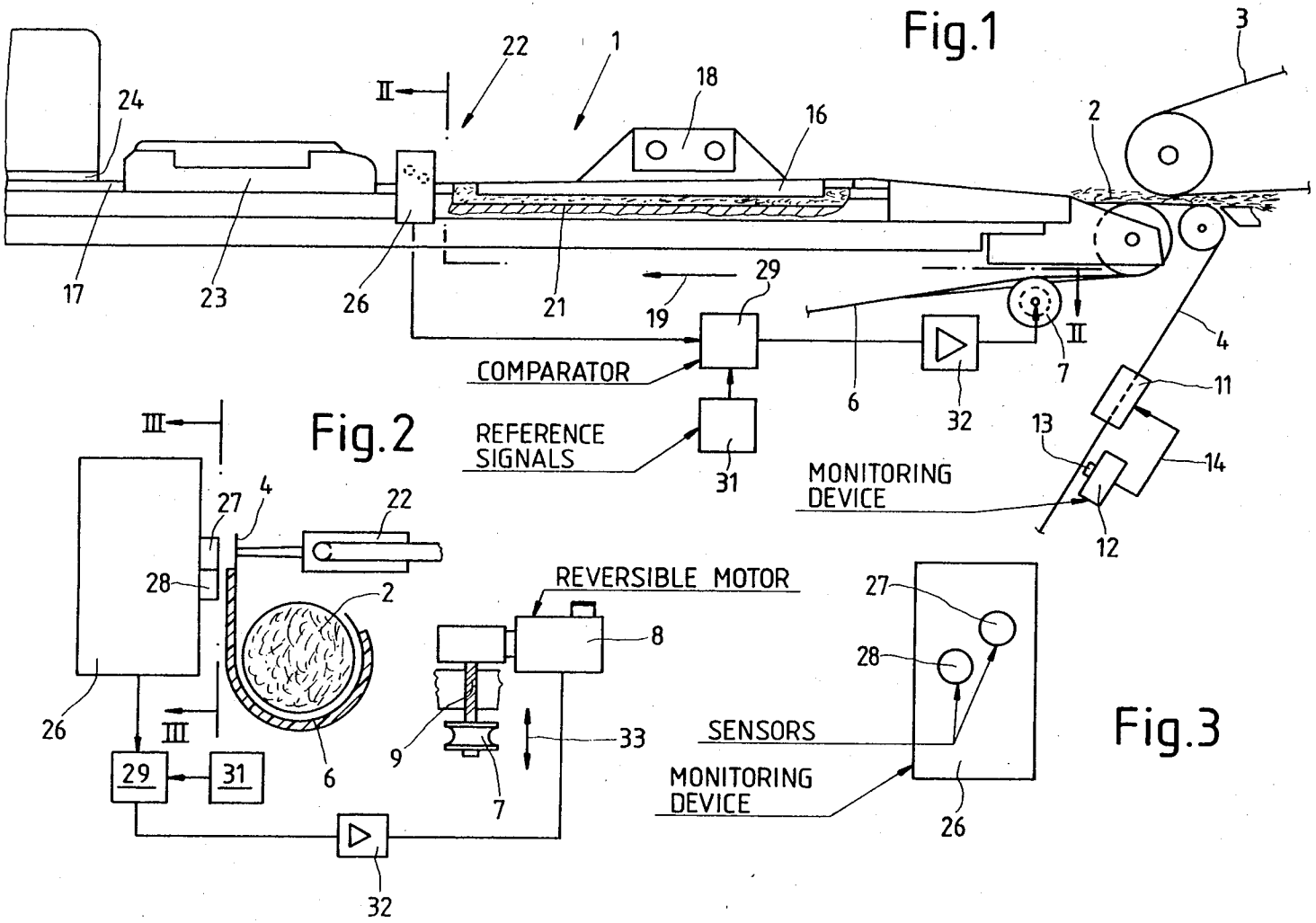
FIG. 1 is a fragmentary schematic partly elevational and partly longitudinal vertical sectional view of a cigarette rod making machine which embodies one form of the invention.
FIG. 2 is an enlarged fragmentary transverse vertical sectional view substantially as seen in the direction of arrows from the line II—II of FIG. 1.
FIG. 3 is a front elevational view of the monitoring means for the conveyor as seen in the direction of arrows from the line III—III in FIG. 2.

FIG. 1 shows a portion of a cigarette rod making machine wherein a wrapping mechanism 1 receives a continuous trimmed or equalized stream 2 of tobacco particles from an endless foraminous belt 3 whose lower reach advances below a stationary suction chamber (not specifically shown) to attract the stream 2 all the way to the location where successive increments of the stream are transferred into a continuous web 4 of cigarette paper or other suitable wrapping material. The lower reach of the conveyor 3 receives a shower of tobacco particles from a duct which forms part of the distributor (also called hopper) of the cigarette rod making machine. Reference may be had, for example, to commonly owned U.S. Pat. No. 4,185,644 or 4,610,260 to Heitmann which discloses a suitable distributor capable of supplying tobacco particles to the conveyor 3. The manner in which a continuous web of cigarette paper is supplied from a bobbin or another suitable source is disclosed in numerous U.S. patents and pending patent applications of the assignee. Reference may be had, for example, to U.S. Pat. No. 4,010,911 to Heitmann.

The means for conveying the web 4 (and the tobacco stream 2 thereon) through the wrapping mechanism 1 comprises an endless flexible belt conveyor 6 which is known as garniture tape or garniture band and is driven by a pulley (see U.S. Pat. No. 4,538,626 to Hinzmann) so that its upper reach advances in the direction of arrow 19. The reference character 7 denotes a guide means in the form of a pulley which has a circumferentially complete peripheral groove bounded by a concave surface (see FIG. 2) serving to guide the web 6 ahead of the inlet of the wrapping mechanism 1. The entire pulley 7 is movable axially (up or down, as seen in FIG. 2 and at right angles to the plane of FIG. 1) by a feed screw 9 which is adapted to be driven by a reversible electric motor 8 forming part of the means for adjusting the guide means 7 for the garniture tape 6. The motor 8 can constitute a commercially available gear motor which can respond to different types of signals in order to move the feed screw 9 axially in a first direction or in a second direction counter to the first direction.

The means for delivering the web 4 to the upper reach of the garniture tape 6 comprises a second guide 11 (e.g., a pulley corresponding to the pulley 7 or a channel which can be shifted in directions at right angles to the plane of FIG. 1 in order to move the respective portion of the web 4 sideways toward or away from the observer of FIG. 1. The arrangement is such that the guide 11 maintains the web 4 in a position of accurate register with the tape 6 at the location where the web 4 comes into contact first with the stream 2 and thereupon with the upper reach of the tape 6. The position of the web 4 ahead of the guide 11 is monitored by a monitoring device 12 which comprises a pair of sensors 13 (only one can be seen in FIG. 1) serving to ascertain the positions of the two marginal portions of the running web and to actuate an adjusting device 14

(e.g., a motor and a feed screw) when the monitored positions of the marginal portions deviate from the required or prescribed positions indicative of an optimum alignment of the web 4 with the tape 6. As shown in FIG. 2, the web 4 can be held in an optimum position when its two marginal portions extend beyond the respective marginal portions of the web 6, for example, to the same extent.

The wrapping mechanism 1 comprises a so-called tongue 16 which contacts the still undraped portion of the stream 2 from above and is configurated and mounted in such a way that its underside slopes gradually toward the upper reach of the tape 6 so that the stream undergoes a progressively increasing compressing or condensing action in order to be converted into a rod-like filler of the cigarette rod 17. Reference may be had, for example, to the commonly owned copending patent application Ser. No. 892,137 filed July 30, 1986 by Gerhard Hakansson et al. for "Wrapping mechanism for cigarette rod making and like machines". As a rule, the compacting action of the tongue 16 will be such that the diameter of the filler is reduced to slightly less than the diameter of the filler in the finished rod 17. The manner in which the rod 17 is subdivided into plain cigarettes of unit length or multiple unit length is known and need not be described here.

The tongue 16 is mounted on the frame of the cigarette rod making machine by a suitable bracket 18 and is followed (as seen in the direction of arrow 19) by a first folding device 21 wherein the web 4 is converted into a U-shaped body which partially confines the filler (compacted stream 2), an adhesive applicator 22 which can comprise a nozzle serving to discharge a narrow stream or film of adhesive against the adjacent upwardly extending marginal portion of the web 4 (see FIG. 2), a second folding device 23 which completes the conversion of the web 4 into a tube by causing the adhesive-coated marginal portion to overlie the other marginal portion and to form therewith a seam extending in parallelism with the axis of the cigarette rod 17, and a so-called sealer 24 which heats or cools the seam, depending upon the nature of adhesive which is discharged by the applicator 22. This applicator can comprise a disc which replaces the nozzle and serves to apply a thin film of adhesive paste to the adjacent upwardly extending marginal portion of the web 4.

When the machine operates properly, the nozzle of the applicator 22 applies a film of adhesive paste at a predetermined distance from the upper (free) edge of the respective marginal portion of the web 4. This can be seen in FIG. 2. The position of the tape 6 (and hence of the web 4 at the concave side of the tape) in the region of the adhesive applicator 22 is monitored by a monitoring device 26 which transmits signals to a signal transmitting unit including a comparator 29 which, in turn, transmits signals to the motor 8 for adjustment of the pulley 7. The nozzle of the applicator 22 is located at one side and the monitoring device 26 is located at the other side of the upwardly extending marginal portion of the web 4 at the station between the tongue 16 and the folding unit 23.

As shown schematically in FIG. 3, the monitoring device 26 comprises a plurality of sensors (27 and 28) which are staggered with reference to each other transversely of the direction of travel of the tape 6 and web 4. Each of the sensors 27, 28 can constitute a commercially available reflection type photoelectronic detector which transmits signals whose intensity changes in response to lateral stray movements of the tape 6 and of the web 4 thereon.

The comparator 29 has a first input which receives signals from the sensors 27, 28, a second input which is connected to a source 31 of reference signals, and an output which is connected with the motor 8. The signals from the source 31 denote the desired or optimum position of the tape 6 at the adhesive-applying station of the rod making machine. The connection between the output of the comparator 29 and the controls for the motor 8 comprises an operational amplifier 32. The motor 8 can be operated to move the feed screw 9 in directions which are indicated by a double-headed arrow 33.

The bracket 18 can be used as a means for maintaining the monitoring device 26 in a predetermined position with reference to the adhesive applicator 22.

In FIG. 2, the pulley 7 maintains the tape 6 and the web 4 thereon in an optimum position, i.e., the orifice or orifices of the nozzle of the applicator 22 apply a film of adhesive at an optimum distance from the free edge of the respective marginal portion of the running web 4. At such time, the upwardly extending marginal portion of the web 4 constitutes a reflector for the beam of radiation which issues from the sensor 27. If the web 6 is shifted sideways in a first or in a second direction, e.g., in a direction that radiation issuing from the sensor 28 is also reflected by the web 4 rather than by the tape 6, the intensity of signal which is generated by the sensors 27, 28 is changed (e.g., increased) and the comparator 29 transmits a signal which effects an appropriate adjustment of the axial position of the pulley 7 until the tape 6 returns to its prescribed (optimum) position. if the tape 6 is shifted in a direction such that radiation issuing from both sensors (27, 28) is reflected by the tape, the intensity of the signal which is transmitted by the sensors is changed again (e.g., reduced) and the comparator 29 causes the motor 8 and the feed screw 9 to shift the pulley 7 axially in the opposite direction, again for the purpose of returning the tape 6 to the position of FIG. 2. The polarity of the signal at the output of the comparator 29 determines whether the feed screw 9 is moved upwardly or downwardly, as seen in FIG. 2. The position of the web 4 is changed with the position of the tape 6 because the outer side of the web is maintained in requisite frictional engagement with the concave side of the tape. Thus, any and all lateral adjustments of the tape 6 are normally shared by the web 4 while the web and the tape are transported through the wrapping mechanism 1.

An important advantage of the improved machine is that a single monitoring device 26 suffices to ascertain the position of the tape 6 as well as of the web 4 on the tape at a location where accurate positioning of the web (with reference to the adhesive applicator 22) is of utmost importance.

The exact construction of the twin sensor which constitutes or forms part of the presently preferred monitoring device 26 forms no part of the present invention. The same applies for the exact construction of the motor 8 and of the controls for the motor which receive signals from the amplifier 32.

The means for adjusting the guide 11, which constitutes a means for directing the web 4 into the wrapping mechanism 1, is an optional but desirable and advantageous feature of the improved machine because the guide 11 invariably ensures that the web 4 reaches the tape 6 in an optimum position for advancement along the path which is defined by the tape 6 and extends through the mechanism 1.

Another important advantage of the improved machine is that the number of rejects due to improper application of adhesive is reduced and that the likelihood of contamination of the machine by adhesive is very remote. Furthermore, the appearance of the cigarettes is highly satisfactory because they do not exhibit patches of dried adhesive adjacent the seam.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for converting a continuous stream of fibrous material and a continuous web of wrapping material into a rod-like product, the combination of a wrapping mechanism; means for directing the web toward said mechanism; means for transporting the stream to said mechanism; means for conveying the web and the stream through said mechanism including an endless conveyor arranged to receive the web from said directing means and the stream from said transporting means and to transport the web and the stream in the mechanism along a predetermined path; adjustable guide means for said conveyor; means for applying to the web adhesive during transport through said mechanism; means for monitoring the position of said conveyor in said mechanism and for generating signals denoting the monitored position of the conveyor; and means for adjusting said guide means in response to said signals.

2. The structure of claim 1, wherein said adjusting means comprises an adjustable motor operable to change the position of said guide means, and means for transmitting signals from said monitoring means to said motor.

3. The structure of claim 2, wherein said signal transmitting means comprises a comparator having a first input for signals from said monitoring means, a second input and an output connected with said motor, and a source of reference signals connected to said second input and arranged to transmit signals denoting the desired position of said conveyor.

4. The structure of claim 1, further comprising means for supporting said monitoring means in a predetermined position with reference to said adhesive applying means.

5. The structure of claim 1, wherein said monitoring means comprises a plurality of photoelectronic sensors.

6. The structure of claim 1, wherein said guide means comprises a pulley having a circumferential groove bounded by a concave surface which contacts the conveyor, said adjusting means comprising means for moving said pulley axially.

7. The structure of claim 1, wherein said directing means comprises second adjustable guide means, means for monitoring the position of the web ahead of said mechanism and for generating second signals, and means for adjusting said second guide means in response to said second signals.

8. The structure of claim 1, wherein said conveyor has an elongated marginal portion and said monitoring means includes means for monitoring the marginal portion of said conveyor.

9. The structure of claim 1, wherein said monitoring means comprises a plurality of sensors adjacent the path of movement of the web with said conveyor.

* * * * *